United States Patent [19]

Iino et al.

[11] Patent Number: 4,538,960

[45] Date of Patent: Sep. 3, 1985

[54] AXIAL THRUST BALANCING DEVICE FOR PUMPS

[75] Inventors: Toshiki Iino; Kunio Kamata, both of Ibaraki, Japan

[73] Assignee: Hitachi, Ltd., Tokyo, Japan

[21] Appl. No.: 234,178

[22] Filed: Feb. 13, 1981

[30] Foreign Application Priority Data

Feb. 18, 1980 [JP] Japan ..... 55-17816

[51] Int. Cl.[3] ..... F01D 3/04

[52] U.S. Cl. ..... 415/104; 415/105

[58] Field of Search ..... 415/104, 105, 106, 112

[56] References Cited

U.S. PATENT DOCUMENTS 898,462 9/1908 Griessmann ..... 415/105
907,343 12/1908 Griessman et al. ..... 415/104
933,345 9/1909 Scheurmann ..... 415/105
1,045,019 11/1912 Griessmann et al. ..... 415/104
3,123,338 3/1964 Borden ..... 415/112

*Primary Examiner*—Henry C. Yuen
*Assistant Examiner*—John Kwon
*Attorney, Agent, or Firm*—Antonelli, Terry & Wands

[57] ABSTRACT

This invention relates to an axial thrust balancing device for pumps which cancels an axial thrust caused by impellers by utilizing a discharge water pressure. In the device, there is provided a small axial gap between a low pressure sidewall of a balancing drum tightly fitted over a shaft of impellers and a flange-like end wall extending inwardly from a stationary wall along the low pressure sidewall of said balancing drum. On application of the device to a vertical pump, in particular, the balancing drum is prevented from being in contact with the end wall during suspension of operation.

2 Claims, 6 Drawing Figures

AXIAL THRUST BALANCING DEVICE FOR PUMPS

BACKGROUND OF THE INVENTION

This invention relates to an axial thrust balancing device for pumps.

In a pump, water is introduced through a suction port by the rotation of impellers and discharged through a discharge port while the respective stages of impellers provide the water with energy to raise its pressure. It is known that an axial thrust is produced by the pressure of water discharged through the discharge port and this axial thrust causes the impellers to move toward the suction side. To cancel such axial thrust, it has been proposed to use an axial thrust balancing device in which a balancing disk is mounted on a shaft behind the last stage impeller, and a stationary wall, such as a casing, extends between the balancing disk and the last stage impeller in a manner so as to define two small gaps between the stationary wall and the opposed balancing disk. One gap is an annular one, and the other gap is an axial one. At one end of the annular gap, a high pressure chamber is formed behind the last stage impeller. An intermediate pressure chamber is formed between the other end of the annular gap and one end of the axial gap. At the other end of the axial gap, a low pressure chamber is formed behind the balancing disk. Thus, the major part of the water introduced through the suction port of the impeller by the operation of the pump, is delivered through the discharge casing, but a part of the water discharged from the last stage impeller is leaked through the pressure chambers and the gaps to the suction side of the pump or to the atmosphere.

Under this condition, as an axial thrust acting on the impellers displaces the shaft to reduce the thickness of the small axial gap, the resistance of flow offered by the gap increases and the flow rate of water flowing therethrough is reduced, so that the pressure in the intermediate pressure chamber rises to push the balancing disk back. More specifically, if the balancing disk is designed in a suitable manner, the axial thrust produced by the pressure difference across the balancing disk can cancel the axial thrust caused by the impellers, to stabilize the displacement of the pump shaft. Such displacement is fine in its magnitude. However, when this construction is applied to a vertical pump, the balancing disk is moved downwardly toward the stationary wall by the weight of the rotary parts during suspension of operation, thereby making it necessary to provide means for avoiding contact between the balancing disk and the stationary wall.

SUMMARY OF THE INVENTION

It is an object of this invention to provide an axial thrust balancing device for pumps, particularly for vertical pumps, which is capable of avoiding contact between rotary parts, such as a balancing disk, and a stationary wall during suspension of operation, which members define therebetween a small axial gap when the pump is in operation.

The present invention provides an axial thrust balancing device for pumps which includes a balancing drum and a stationary wall with a flange-like end wall extending inwardly along the low pressure sidewall of the balancing drums. A small annular gap is defined between the balancing drum and the stationary wall, and a small axial gap is defined between the low pressure sidewall of the balancing drum and the flange-like end wall at a small radius position.

Additional objects, features and advantages of the invention will become apparent from the description set forth hereinafter when considered in conjunction with the accompanying drawings.

DESCRIPTION OF THE PREFERRED EMBODIMENTS

Figure 1:
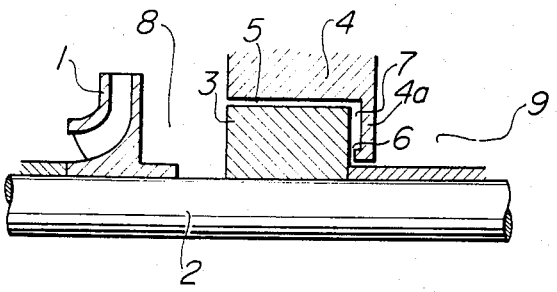
FIG. 1 is a cross sectional view of an axial thrust balancing device for pumps according to an embodiment of the invention.

As shown in FIG. 1, a last stage impeller is securely fitted over a shaft 2. The shaft 2 also has secured thereto a balancing drum 3 which, on a low pressure sidewall thereof, faces a flange-like end wall portion 4*a* of a stationary wall 4 extending therefrom to form a gap 6 therebetween, with an outer peripheral surface of the balancing drum 3 and a surface of the stationary wall forming an annular gap 5. An intermediate pressure chamber 7 is formed between the end wall portion 4*a* and the balancing drum 3, with a high pressure chamber being provided between the last stage impeller 1 and balancing drum 3. A low pressure chamber 9 is provided behind the balancing drum 3 and communicates with a suction port (not shown) of the pump. Thus a pressure difference substantially corresponding to a total head of the pump is applied between the high pressure chamber 8 and the low pressure chamber 9, and a portion of the water discharged from the impeller 1 leaks from the pressure chamber 8 of high pressure through the annular gap 5, intermediate pressure chamber 7 and gap 6 into the low pressure chamber 9. The pressure of water thus leaked gradually reduces from the pressure level prevailing in the high pressure chamber 8 to the pressure level prevailing in the low pressure chamber 9 due to the resistance of flow offered by the gaps 5 and 6. The pressure in the pressure chamber 7 is governed by the magnitude of the resistance of flow offered by the gaps 5 and 6. The resistance of flow offered by the gap 5 is not varied even if the rotary parts moves axially, but the resistance of flow offered by the gap 6 greatly depends on the axial movement of the rotary parts. More specifically, as the small gap 6 is reduced in its thickness under the balancing condition during operation, the pressure drop in the gap 6 increases, so that the pressure in the pressure chamber 7 rises in a manner as to enlarge the gap 6.

Figure 2:
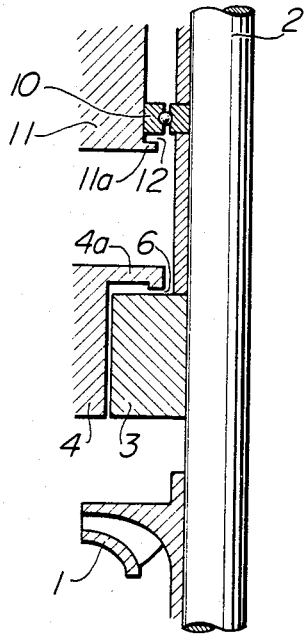
FIG. 2 is a cross sectional view of an axial thrust balancing device according to the invention when applied to a vertical pump.

FIG. 2 shows the axial thrust balancing device according to the invention which is applied to a vertical pump. As shown in FIG. 2, a bearing 10 supports the shaft 2 in a casing 11. The casing 11 is formed with a projection 11*a* which is brought into contact with the outer peripheral portion of the bearing 10 to bear the weight of the rotary parts during suspension of operation. A small gap 6 defined between a balancing drum 3 and an end wall portion 4*a* of a stationary wall 4 is designed such that its thickness during suspension of operation becomes ten to twenty times as that during operation. When the pump operates, the shaft 2 shifts upwardly by virtue of the axial thrust balancing function to define a predetermined gap 12 between the bearing 10 and the projection 11*a*, so that no thrust load acts on the bearing 10.

Figure 3:
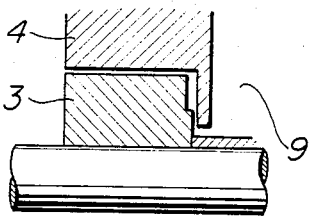
FIGS. 3 to 6 are cross sectional views showing modifications of small gaps of an axial thrust balancing device for pumps according to the invention.
Figure 4:
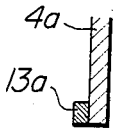
Figure 5:
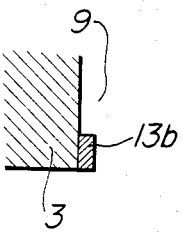
Figure 6:
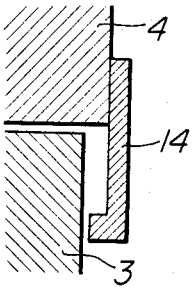

In FIG. 3, a gap is defined between a smooth end wall portion of a stationary wall 4 and an extension of an inner peripheral portion of a balancing drum 3 which extends toward a pressure chamber 9. A gap shown in FIG. 4 is defined between a balancing drum 3 and a projection 13*a* attached to an end wall portion 4*a* of a stationary wall 4. A gap shown in FIG. 5 is defined between an end wall portion 4*a* of a stationary wall 4 and a projection 13*b* attached to an inner peripheral portion of the balancing drum 3 on the side of the pressure chamber 9. In FIG. 6, a gap is defined between a balancing drum 3 and a projection 14 secured to a side face of a stationary wall 4 and opposed to a side face of the balancing drum 3.

From the foregoing description, it will be appreciated that according to the invention there is provided an axial thrust balancing device comprising a small gap defined between a balancing drum 3 and an end wall portion 4*a* extending from a stationary wall 4 and facing the side surface of the balancing drum 3 on the low pressure side thereof. When the axial thrust balancing device according to the invention is applied to a vertical pump, the balancing drum 3 is prevented from coming into contact with the end wall portion 4*a* of the stationary wall during suspension of operation, and no thrust load is applied to the bearing during operation, thereby prolonging the service life of the bearing.

What is claimed is:

1. An axial thrust balancing device for pumps, the thrust balancing device comprising:

a balancing drum secured to a shaft of impellers at a side of a last stage of said impellers for rotation therewith;

a stationary wall having a flange-like end wall portion extending inwardly along a low pressure sidewall of said balancing drum;

a small annular gap defined between said balancing drum and said stationary wall;

a small annular axial gap defined between the low pressure sidewall of said balancing drum and the end wall portion of the stationary wall at a small radius position;

a high pressure chamber defined by the last stage of said impellers, said stationary wall and the high pressure side wall of said balancing drum;

an intermediate pressure chamber defined between said annular gap and said axial gap by said flange-like end wall portion of said stationary wall and the low pressure sidewall of said balancing drum; and a low pressure chamber defined at a rear side of said flange-like end wall portion of said stationary wall.

2. An axial thrust balancing device according to claim 1, wherein said pump is a vertical pump including a rotary shaft with a bearing means adapted for rotatably supporting the shaft in a vertical direction, a casing means for supporting said bearing, and a projection means extending from said casing for limiting a downward movement of said bearing means.

* * * * *